US006064144A

United States Patent [19]

Knoll et al.

[11] Patent Number: 6,064,144

[45] Date of Patent: May 16, 2000

[54] SPARK PLUG FOR AN INTERNAL COMBUSTION ENGINE AND PROCESS FOR ITS MANUFACTURE

[75] Inventors: Harald Knoll, Oberstenfeld; Erwin Schneck, Bretzfeld-Rappach; Werner Niessner, Steinheim; Dirk Von Hacht, Grossbottwar; Heinz Ambacher, Benningen, all of Germany

[73] Assignee: Beru AG, Ludwigsburg, Germany

[21] Appl. No.: 09/022,440

[22] Filed: Feb. 12, 1998

[30] Foreign Application Priority Data

Feb. 12, 1997 [DE] Germany ..... 197 05 372

[51] Int. Cl.[7] ..... H01T 13/20

[52] U.S. Cl. ..... 313/141; 313/138; 313/139; 445/7

[58] Field of Search ..... 313/138, 139, 313/141; 123/169 R, 169 EL; 445/7

[56] References Cited

U.S. PATENT DOCUMENTS

| | | | |
|---|---|---|---|
| 2,416,107 | 2/1947 | Litton . | |
| 4,092,558 | 5/1978 | Yamada | 313/131 R |
| 5,014,656 | 5/1991 | Leptich et al. | 123/169 EL |
| 5,408,961 | 4/1995 | Smith | 123/169 R |
| 5,430,346 | 7/1995 | Johnson | 313/139 |

FOREIGN PATENT DOCUMENTS

| | | |
|---|---|---|
| 44 22 939 | 1/1996 | Germany . |
| 588074 | 5/1947 | United Kingdom . |
| WO 87/07777 | 12/1987 | WIPO . |
| WO 91/06142 | 5/1991 | WIPO . |

OTHER PUBLICATIONS

Patent abstracts of Japan, vol. 14, No. 070, (E–0886), Feb. 8, 1990 & JP 01 289084 A NGK Spark Plug Co. Ltd., Nov. 21, 1989, English Abstract.

Patent Abstracts of Japan, vol. 096, No. 011, Nov. 29, 1996, & JP 08 171976 A Nippondenso Co. Ltd., Jul. 2, 1996, English Abstract.

*Primary Examiner*—Nimeshkumar D. Patel
*Assistant Examiner*—Todd Reed Hopper
*Attorney, Agent, or Firm*—Nixon Peabody LLP; David S. Safran

[57] ABSTRACT

A spark plug, especially one for a gas-fueled internal combustion engine has an electrically conducting spark plug body (1), a central electrode (3) which is located in the spark plug body (1) and which is electrically insulated from and projects away from the spark plug body (1), and a ground electrode (4) which is electrically connected to the spark plug body (1) and is made in the form of an annular electrode. The annular electrode (4) surrounds the front part of central electrode (3) such that an annular ignition gap (ZS) is formed between them. Surfaces of the central electrode (3) and the annular electrode (4) bordering the ignition gap (ZS) are provided with precious metal armorings in the form of sleeves (5, 6,), especially of platinum or a platinum alloy. This yields a spark plug with an extremely long service life. A method for producing this spark plug involves the steps of forming a concentric centering groove in the spark plug body for the ground electrode, forming welding cams on the ground electrode, and inserting the ground electrode with the welding cams into the centering groove of the spark plug body and welding the welding cams to the spark plug body.

16 Claims, 5 Drawing Sheets

SPARK PLUG FOR AN INTERNAL COMBUSTION ENGINE AND PROCESS FOR ITS MANUFACTURE

BACKGROUND OF THE INVENTION

1. Field of the Invention

The invention relates to a spark plug for an internal combustion engine, especially one which is gas fueled. More specifically, the invention relates to a spark plug with an electrically conducting spark plug body, a central electrode which is located in the spark plug body and which is electrically insulated and projects away from the spark plug body, and a ground electrode which is electrically connected to the spark plug body and which is made in the form of an annular electrode which surrounds the projecting part of the central electrode with an annular ignition gap formed between them.

2. Description of Related Art

A spark plug of the initially mentioned type is known from International Patent Publication WO 91/06142.

The service life requirements for spark plugs for internal combustion engines are increasing considerably at present; this applies especially to spark plugs which are to be used in large-volume, high compression gas-fueled internal combustion engines which are operated in a fixed position. Spark plugs for such a use should have long running time, roughly at least 5000 hours. Since these internal combustion engines operate with high pressure, special importance must be placed on the spark gap. Actually spark gaps of 0.2 to 0.3 mm are nominally set; this means that at a misfire limit of these internal combustion engines of 0.5 to 0.6 mm, according to experience, the potential electrode erosion reserve of 0.2 to 0.3 mm is quickly used up and the misfire limit is quickly reached. Currently available spark plugs do not satisfy the requirement for a long service life; this results in costly replacement of spark plugs.

SUMMARY OF THE INVENTION

The object of the invention is therefore to improve a spark plug of the initially mentioned type such that it has a longer service life.

This object is achieved in accordance with the present invention by a precious metal armoring being provided on the outer surface of the central electrode bordering the ignition gap.

In the spark plug of the invention, as a result of the precious metal armoring, small ignition gaps can be formed and the spark gap can be kept constant for a very long time. A large spark emission surface can be provided so that the expectations for long service life can be satisfied.

Furthermore, in the spark plug of the invention, it is possible to optimize the spark position, i.e., to move the spark gap as far as possible in the combustion space in order to ignite even extremely lean mixtures without misfires.

The subject matter of the invention is furthermore a process for manufacturing the spark plug of the invention.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
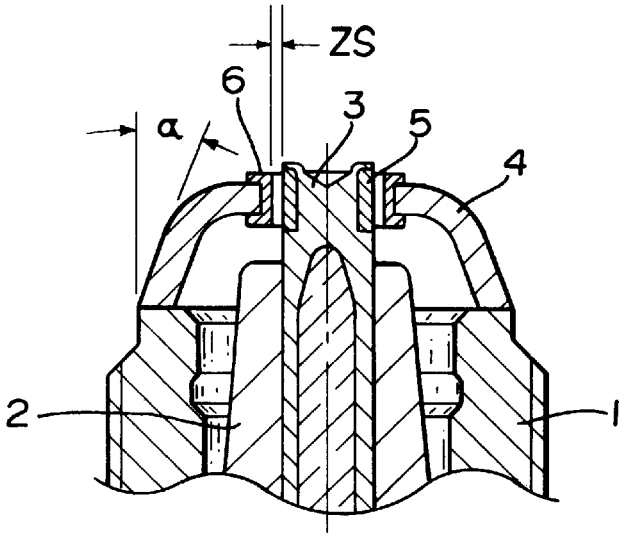
FIG. 1 is a cross sectional view of the ignition-side electrode configuration of one embodiment of a spark plug in accordance with the present invention.

The embodiment of an embodiment of a spark plug in accordance with the present invention shown in FIG. 1 comprises a metal body 1 with screw-in thread in which there is a ceramic insulator 2 centrally located. As shown in FIG. 1, the spark plug has a advanced or moved up spark position in which insulator 2 projects approximately 6 mm beyond the front edge of the metal body 1 into the combustion space of the internal combustion engine. In the middle of the ceramic insulator 2 is a central electrode 3 which, together with ground electrode 4, forms an ignition gap ZS for formation of an ignition spark. Ground electrode 4 is electrically connected to the metal body 1 and is made in the form of an annular electrode which surrounds the entire periphery of the central electrode 3.

To use as much as possible of the available electrode erosion reserve, the spark gap between the central electrode 3 and the annular electrode 4 is made annular, such that the entire jacket or outer surface of central electrode 3 and the inner surface of the hole of annular electrode 4 can be used as a spark emission surface and is available as an electrode erosion reserve. The service life of a spark plug with this configuration of the spark gap is greatly increased by the use of an erosion-proof material, specifically a precious metal, such as platinum or a platinum alloy. As is shown in FIG. 1, for this purpose, throughout the area of the spark gap, the potential spark emission surface is lined with a precious metal. Central electrode 3 in the ignition-side area, i.e., in the section of the spark gap or on the surface which borders the spark gap, is provided with precious metal armoring in the form of precious metal sleeve 5. Annular electrode 4 on its inside, i.e. on the surface bordering the spark gap, is provided with a precious metal sleeve 6. Precious metal sleeve 5 and precious metal sleeve 6 are made especially of platinum or a platinum alloy.

To attach precious metal sleeve 5 to central electrode 3, on the ignition-side end of central electrode 3, there is a reduction onto which precious metal sleeve 5 is pushed or pressed. On the face of central electrode 3, for example, by countersinking or drilling, a depression is formed so that an annular rim results. This rim is crimped over precious metal sleeve 5, by which a form-fitted connection is produced. Precious metal sleeve 5 can also be welded to central electrode 3.

Precious metal sleeve 6 is attached to the annular electrode 4 by inserting and pressing precious metal sleeve 6 into the hole in annular electrode 4 such that, on the ignition-side end, the precious metal sleeve 6 projects annularly above the annular electrode 4. The projecting edge of precious metal sleeve 6 is crimped or riveted to achieve a form-fitted connection. Precious metal sleeve 6 can also be welded to the annular electrode 4.

Annular electrode 4 is formed and bent in a bell-shape, and is connected to the body 1 at an angle $\alpha$ of from 10 to 30°. Less metal surface is exposed to combustion heat by this oblique adjustment of annular electrode 4, so that annular electrode 4 during operation tends to less auto-ignition.

Figure 3:
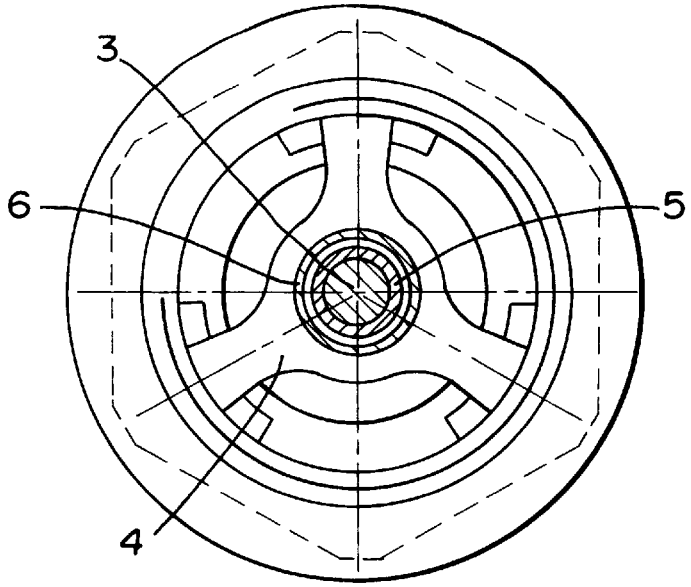
FIG. 3 is a plan view of the ground electrode of one embodiment of the spark plug of the invention.
Figure 4:
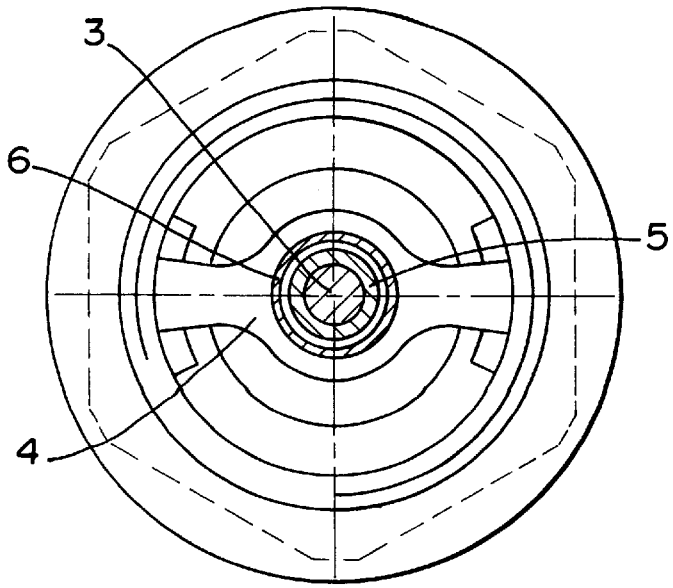
FIG. 4 is a plan view of the ground electrode of another embodiment of the spark plug in accordance with the invention.
Figure 5D:
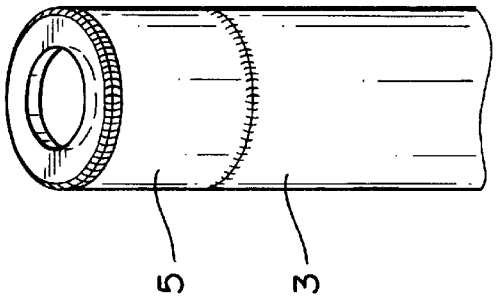
FIGS. 5A–5D are perspective views showing respective working steps in one embodiment of the process of the invention.
Figure 5C:
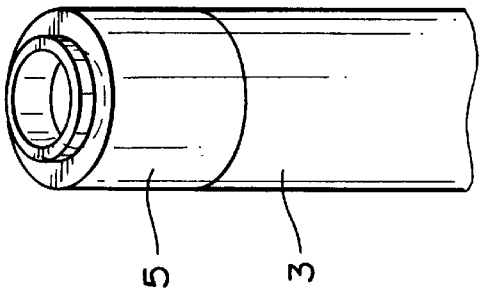
Figure 5B:
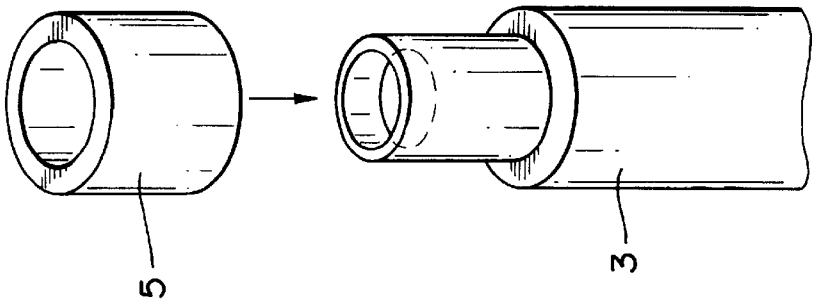
Figure 5A:
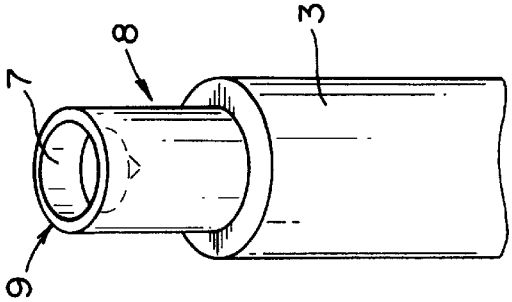

As is shown in FIG. 3, annular electrode 4 is preferably made star-shaped with three spoke-like prongs which are bent in a bell shape and on their ends are welded to body 1. Annular electrode 4 can be made with more than three spoke-like prongs or can also have only two spokes, as is shown in FIG. 4. In the embodiment shown in FIG. 4, after bending the prongs, a hoop-like annular electrode is formed. This embodiment shown in FIG. 4 has the special advantage of better flushing with the mixture and reduction of the quenching effect, for example, prevention of flame propagation.

To expose less metal surface to combustion heat, the spoke-like prongs of annular electrode 4 are also reductioned toward the electrode ring, so that the cross section of annular electrode 4 always becomes larger toward the cold part of body 1 and optimum heat dissipation is guaranteed.

Figure 2:
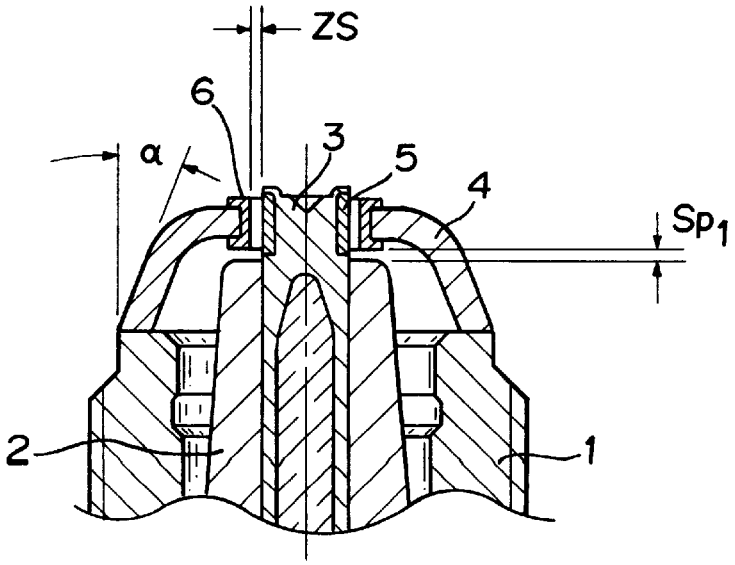
FIG. 2 is a cross sectional view of the ignition-side electrode configuration of another embodiment of a spark plug in accordance with the present invention.

In the embodiment shown in FIG. 2, spark gap ZS is made with a gap $Sp_1$ such that the spark gap, i.e. ignition gap ZS and gap $Sp_1$ between the insulator base tip and the lower edge of annular electrode 4 are laid out at least in a 1:1 ratio, and after using up air spark gap ZS, a spark can form as a combined creeping and air spark between gap $Sp_1$.

FIG. 5 shows the sequence of production of central electrode 3 with a precious metal sleeve, especially platinum sleeve 5. FIG. 5A shows central electrode 3 which has a reduced outer diameter on the ignition-side end, for example, by turning, reduction or cold extrusion. The face of central electrode 3 is made with a depression 7, for example, by countersinking or counterdrilling so that, between reduction 8 and depression 7, there is an annular rim 9. As is shown in FIG. 5B, a platinum sleeve 5 is place on the central electrode 3, i.e., especially is pushed or pressed on. Then, according to FIG. 5C, the platinum sleeve 5 fixed to the central electrode 3 clinching rim 9. In the step shown in FIG. 5D, platinum sleeve S is also welded or soldered to central electrode 3 after clinching.

FIG. 6 shows the working steps in the production of annular electrode 4 in the embodiment shown in FIG. 3.

Figure 6E:
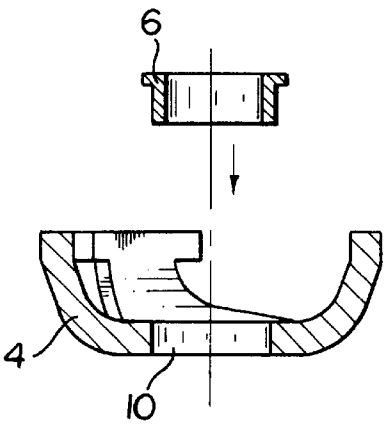
FIGS. 6A–F show the different working steps in the production of the ground electrode in one embodiment of the process of the invention.
Figure 6F:
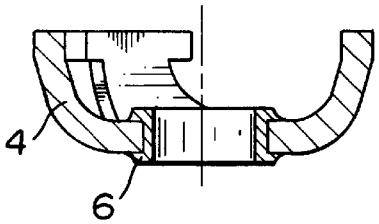
Figure 6C:
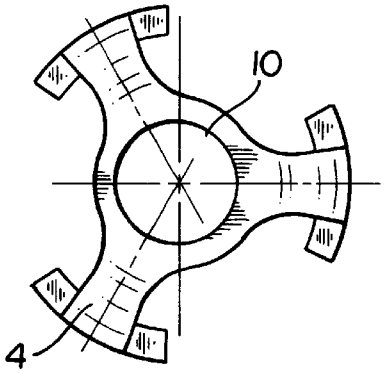
Figure 6D:
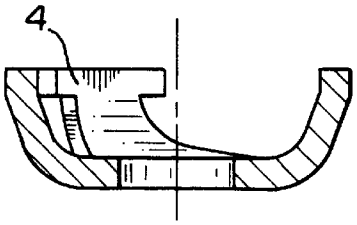
Figure 6A:
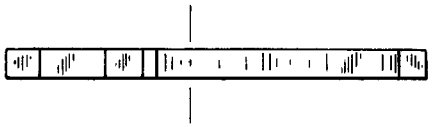
Figure 6B:
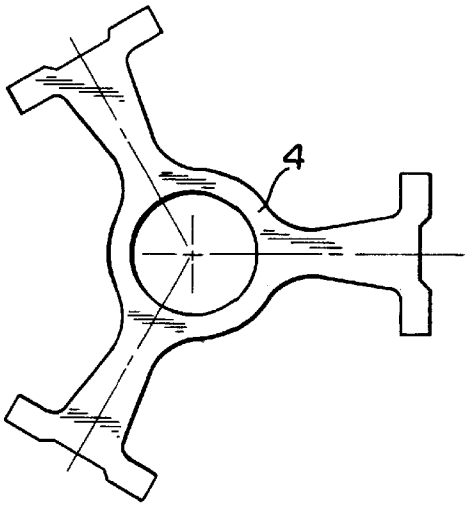

In the working step shown in FIG. 6A, the outer and inner contours of annular electrode 4 are produced in one piece from a metal strip, for example, a nickel strip or nickel alloy strip, for example, by punching. In the working step shown in FIG. 6B, the annular electrode 4 is bent into a bell shape. Then, in the working step according to FIG. 6C, the annular electrode 4 is reinforced with precious metal sleeve 6. In this case, the precious metal sleeve 6 is pressed into hole 10 of annular electrode 3, and then, the projecting ends of precious metal sleeve 6 are clinched by beading in order to achieve armoring of a stable shape, as shown in FIG. 6D. The connection between precious metal sleeve 6 and annular electrode 4 can be also welded or soldered.

If precious metal sleeve 6 is a platinum sleeve, annular electrode 4 is produced from Inconel in order to achieve a good connection between the platinum sleeve and the Inconel annular electrode.

Furthermore, the annular electrode 4 and/or precious metal sleeve 6 can be produced from a binary material which is made, for example, of nickel with a platinum coating. For reasons of cost, the carrier material is then nickel and the erosion-proof platinum coating is made by surface plating. In this way, the consumption of high quality precious metal can be kept as small as possible.

In this production of annular electrode 4 and central electrode 3, precious metal armorings are thus attached mechanically, for example, by beading and pressing. Welding of the precious metal armorings after mounting offers an additional safeguard. In this way, the precious metal is attached over a large area, so that there are no concentricity problems in the arrangement of the precious metal.

In the following one especially preferred embodiment of a process for attaching annular electrode 4 to body 1 is described using FIGS. 7 and 8.

It happens that the spark gap is nonuniform because annular electrode 4 is not centered, and that different wall thicknesses of annular electrode 4 lead to poorer heat dissipation. When annular electrode 4 is not welded centered onto metal body 1, it must be repunched and deburred inside and outside.

Figure 8:
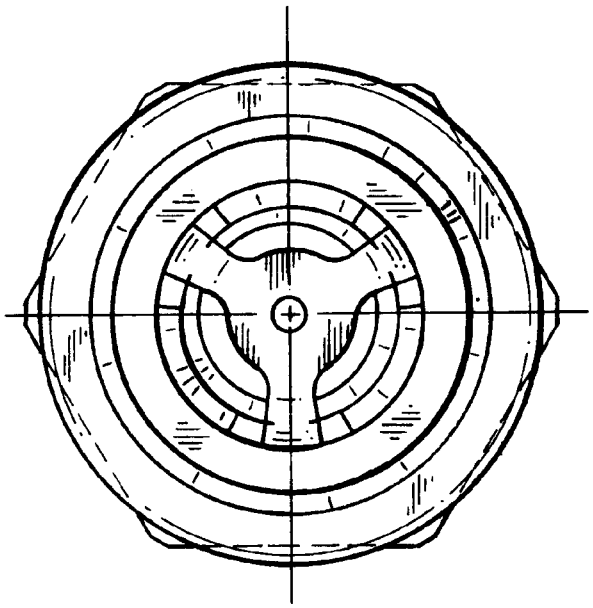
FIGS. 7 and 8 are, respectively, partial cross-sectional and plan views illustrating one manner of attaching the annular electrode in accordance with the invention.
Figure 7:
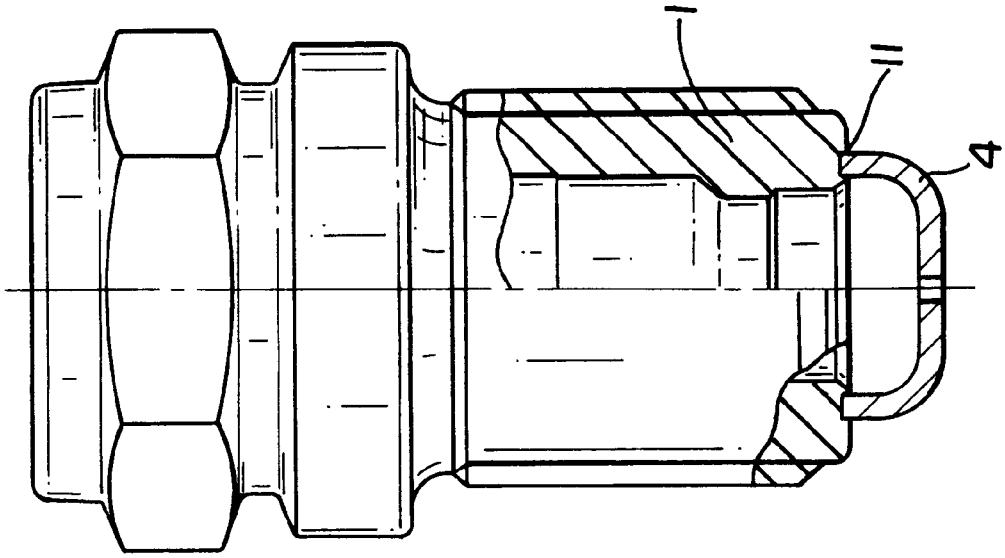

To solve these problems, as shown in FIGS. 7 & 8, a centering groove 11 for annular electrode 4 is provided concentrically in body 1, welding cams are molded onto annular electrode 4, and the body 1 is then welded to the welding cams in the centered arrangement in centering groove 11 with body 1.

In this design, simple centering of annular electrode 4 in concentrically formed centering groove 11 on body 1 is possible. Annular electrode 4 can therefore be finished-punched beforehand; repunching of the hole in the state already attached to body 1 is eliminated. At the same time, deburring of the weld point becomes superfluous since the material flows into centering groove 11.

The centered mounting of annular electrode 4 achieved in this way leads to a uniform spark gap and uniform heat dissipation. In this way, two-, three-, and four-pin spark plugs can be produced from annular electrodes for 14 and 18 threads.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. A spark plug comprising:

an electrically conducting spark plug body;

a central electrode which is located in the spark plug body and which is electrically insulated relative to the spark plug body and has a part which projects away from the spark plug body;

a ground electrode which is electrically connected to the spark plug body and which is an annular electrode which surrounds the projecting part of the central electrode in a manner forming an annular ignition gap therebetween, the projecting part extending through the annular electrode;

wherein an annular precious metal armoring is provided on a outer surface of the central electrode bordering the ignition gap.

2. Spark plug as claimed in claim 1, wherein the annular electrode is provided with a precious metal armoring on an annular surface thereof bordering the ignition gap.

3. Spark plug as claimed in claim 2, wherein the precious metal armoring on annular electrode comprises a precious metal sleeve; and wherein the annular precious metal armoring on the central electrode is in the form of a precious metal sleeve provided on the projecting part of the central electrode.

4. Spark plug as claimed in claim 1, wherein a precious metal armoring in the form of a precious metal sleeve is provided on an area of the central electrode within the ignition gap.

5. Spark plug as claimed in claim 1, wherein the annular electrode is made of a material selected from the group consisting of nickel and a nickel alloy.

6. Spark plug as claimed claim 1, wherein the annular electrode is made of Inconel and the precious metal of the precious metal armoring is selected from the group consisting of platinum and a platinum alloy.

7. Spark plug as claimed in claim 3, wherein the precious metal armoring of at least one of the central electrode and the annular electrode is comprised of a binary material.

8. Spark plug as claimed in claim 7, wherein the binary material is comprised of a carrier material formed of nickel or a nickel alloy and a platinum coating thereon.

9. Spark plug as claimed in claim 1, wherein the ground electrode is made in the form of an annular electrode having star-shaped spokes by which it is connected to the spark plug body, the annular ignition gap being formed between a hole in the ground electrode and the central electrode.

10. Spark plug as claimed in claim 1, wherein a creeping spark distance is formed between a tip of the projecting part of the insulator and a lower edge of the ground electrode.

11. Spark plug as claimed in claim 10, wherein an air spark distance of the ignition gap and the creeping spark distance are in a ratio of 1:1.

12. Spark plug as claimed in claim 8, wherein the star-shaped spokes of the ground electrode are formed in a bell shape.

13. Spark plug as claimed in claim 12, wherein the star-shaped spokes are connected to the body at an angle of 10 to 30°.

14. Spark plug as claimed in claim 1, wherein the spark plug has a pulled up spark position in which the insulator projects approximately 6 mm beyond the front edge of the metal body.

15. Spark plug as claimed in claim 1, wherein the ground electrode is made of Inconel.

16. Process for producing a spark plug having an electrically conducting spark plug body, a central electrode which is located in the spark plug body and which is electrically insulated relative to spark plug body and has a part which projects away from the spark plug body, a ground electrode which is electrically connected to the spark plug body and which is an annular electrode which surrounds the projecting part of the central electrode in a manner forming an annular ignition gap therebetween, the projecting part extending through the annular electrode, and an annular precious metal armoring provided on a jacket surface of the central electrode bordering the ignition gap, comprising the steps of forming a concentric centering groove, having a circumferentially extending bottom wall which is radially flanked on opposite sides by circumferentially extending side walls, in a top surface of the spark plug body for the ground electrode, forming welding cams on the ground electrode, and inserting the welding cams of the ground electrode into the centering groove of the spark plug body and welding the welding cams to the spark plug body, whereby material flows into the centering groove during welding for eliminating the need to subsequently perform deburring of resulting weld points.

* * * * *